US006809685B2

(12) United States Patent
Hancock

(10) Patent No.: US 6,809,685 B2
(45) Date of Patent: Oct. 26, 2004

(54) CALIBRATION APPARATUS AND METHOD FOR USE WITH ANTENNA ARRAY

(75) Inventor: Christopher James Hancock, Winchester (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/343,047

(22) PCT Filed: Jul. 30, 2001

(86) PCT No.: PCT/EP01/08787

§ 371 (c)(1),
(2), (4) Date: Apr. 18, 2003

(87) PCT Pub. No.: WO02/11237

PCT Pub. Date: Feb. 7, 2002

(65) Prior Publication Data

US 2003/0160719 A1 Aug. 28, 2003

(51) Int. Cl.[7] ..... H01Q 3/22
(52) U.S. Cl. ..... 342/368; 342/174
(58) Field of Search ..... 342/165, 173, 342/174, 368, 374

(56) References Cited

U.S. PATENT DOCUMENTS

| | | | | |
|---|---|---|---|---|
| 5,248,982 A | * | 9/1993 | Reinhardt et al. | 342/375 |
| 5,412,414 A | | 5/1995 | Ast et al. | |
| 5,543,801 A | * | 8/1996 | Shawyer | 342/354 |
| 5,909,191 A | | 6/1999 | Hirshfield et al. | |
| 5,936,569 A | | 8/1999 | Ståhle et al. | |

FOREIGN PATENT DOCUMENTS

EP 0 901 183 A2 3/1999

* cited by examiner

*Primary Examiner*—Dao Phan
(74) *Attorney, Agent, or Firm*—Squire, Sanders & Dempsey L.L.P.

(57) ABSTRACT

A system for use with an antenna array having a plurality of antennas, said system comprising a first calibration arrangement for calibration of signals of said antenna array; a second calibration system for calibration of signals of said antenna array; and selection means for selecting one of said calibration arrangements for calibrating signals of said antenna array.

23 Claims, 8 Drawing Sheets

CALIBRATION APPARATUS AND METHOD FOR USE WITH ANTENNA ARRAY

FIELD OF INVENTION

The present invention relates to a calibration apparatus and method for use with an antenna array. In particular, but not exclusively, the present invention is applicable to phased antenna arrays for use in cellular telecommunication networks using beam steering.

BACKGROUND TO THE INVENTION

With currently implemented cellular telecommunication networks, a base transceiver station (BTS) is provided which transmits signals intended for a given mobile station (MS), which may be a mobile telephone, throughout a cell or cell sector served by that base transceiver station. However, in space division multiple access systems, the base transceiver station will only transmit a signal in a beam direction from which a signal from the mobile station is received. In other words, the base transceiver station does not transmit a signal throughout the cell or cell sector. The base transceiver station is also able to determine the direction from which the signals from mobile stations are received. SDMA is one example of beam steering. Other types of beam steering are also known.

To direct the beam in a given direction, the base transceiver station will generally have a phased antenna array. Typically, such an antenna array will comprise a number of antennas, for example 4 or 8 antennas, arranged with a spacing of, for example, one half of a wavelength therebetween. A signal to be transmitted is supplied to each of the antennas but with different relative phases. Depending on these phase differences, there will be constructive interference in the desired beam direction and destructive interference in the undesired directions. In order to ensure that the beam is provided only in the desired direction, it is important to ensure that the signal to be transmitted is provided to each of the antennas with the correct relative phase shift. In other words the same signal is applied to each of the antennas but with different relative phases. Likewise, in order to determine the direction from which a signal has been received, it is necessary to analyse the relative phase shifts of the signal received at each of the antennas. Typically, the processing means for generating the relative phase shifts for signals to be transmitted and for analysing the relative phase shifts of received signals is some distance from the antennas. Accordingly, differences in the length of the cabling between each antenna and the processing means as well as differences in temperature in the different cabling can adversely effect the relative phases. If this occurs, then the beam may not be generated in the desired direction. In the case of received signals, it will not be possible to accurately determine the direction from which a signal has been received.

Calibration circuitry can be used to ensure that the beams produced by the antenna array are as desired by the base station. The circuitry should be placed close to the antenna. This is to ensure accuracy. The antennas in base stations tend to be located at the top of a mast and therefore make the calibration circuitry difficult to maintain and replace. Furthermore, if the calibration circuitry is damaged or fails to operate correctly, there is an increased likelihood of the base station failing to operate. This would put unnecessary pressure on the network to service the subscribers who would normally be serviced by the inoperable base station. It may leave an area, and the subscribers within that area, without any network coverage for an extended period of time. Base stations which use beam steering can service a relatively large number of people at the same time. To have such a base station out of action would adversely affect a network. Some base stations may be located in countries where severe winters mean that the base station can not be accessed during winter and repaired. To have a base station non operational for this length of time is clearly disadvantageous.

SUMMARY OF INVENTION

It is therefore an aim of embodiments of the present invention to address this problem.

According to a first aspect of the present invention, there is provided a system for use with an antenna array having a plurality of antennas, said system comprising a first calibration arrangement for calibration of signals of said antenna array; a second calibration system for calibration of signals of said antenna array; and selection means for selecting one of said calibration arrangements for calibrating signals of said antenna array.

BRIEF DESCRIPTION OF DRAWINGS

For a better understanding of the present invention and as to how the same may be carried into effect, reference will now be made by way of example to the accompanying drawings in which.

DETAILED DESCRIPTION OF EMBODIMENTS OF THE INVENTION

Figure 1:
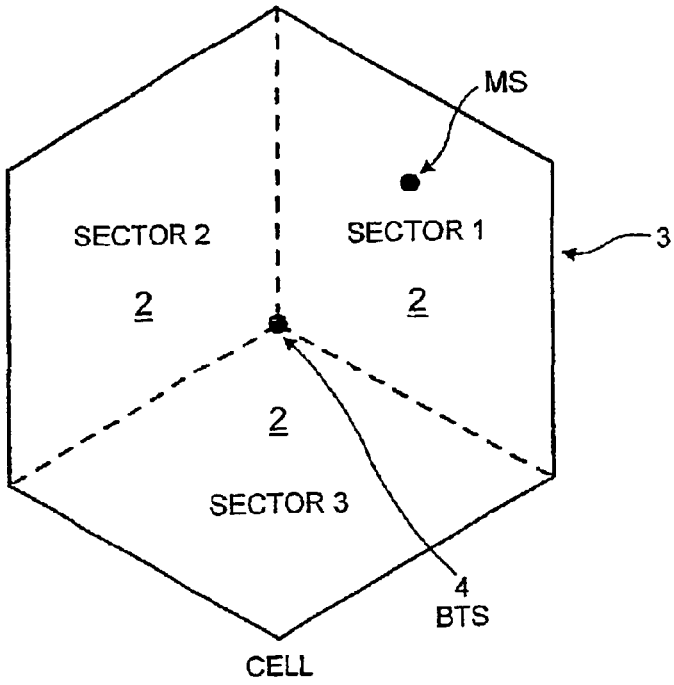
FIG. 1 shows a schematic view of a base transceiver station and its associated cell sectors.

Reference will first be made to FIG. 1 in which three cell sectors 2 defining a cell 3 of a cellular mobile telephone network are shown. The three cell sectors 2 are served by respective base transceiver stations 4. Three separate base transceiver stations are in fact provided in the same location. Each base transceiver station 4 has a separate transceiver which transmits and receives signals to and from a respective one of the three cell sectors 2. Thus, one dedicated base transceiver station is provided for each cell sector 2. The base transceiver station 4 is thus able to communicate with mobile stations MS such as mobile telephones which are located in a respective cell sector 2.

The present embodiment as described in the context of a GSM (Global System for Mobile Communications) network. In the GSM system, a frequency/time division multiple access (F/TDMA) system is used. Data is generally transmitted between the base transceiver 4 and the mobile station in bursts. Each data burst is transmitted in a given frequency band in a predetermined time slot in that frequency band. The use of a phased antenna array, sometimes also referred to as a directional antenna array or smart antenna array, allows beam steering such as space division multiple access also to be achieved. Thus, in embodiments of the present invention, each data burst will be transmitted in a given frequency band, in a given time slot, and in a given direction. The associated channel can be defined for a given data burst transmitted in the given frequency, in the given time slot and in the given direction. However, it should be appreciated that in some embodiments of the present invention, the same data burst can be transmitted in the same frequency band, in the same time slot but in two or more different directions. Embodiments of the present invention can be used with other types of beam steering other than space division multiple access.

Figure 2:
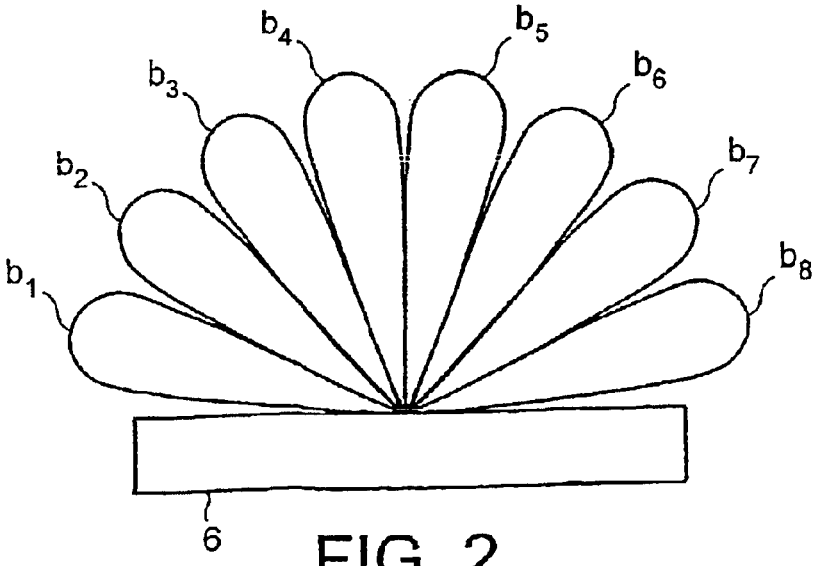
FIG. 2 shows a simplified representation of a possible beam pattern provided by an antenna array.

FIG. 2 shows the directional radiation pattern which may be achieved by a phased antenna array 6 comprising eight antennas (not shown) spaced apart by a distance equal to one half the wavelength. The antenna array 6 can be controlled to provide a beam b1 . . . b8 in any one of the eight directions illustrated in FIG. 2. For example, the antenna array 6 could be controlled to transmit a signal to a mobile station only in the direction of beam b5 or only in the direction of beam b6. It is also possible to control the antenna array to transmit a signal in more than one beam direction at the same time. It should be appreciated that FIG. 2 is only a schematic representation of eight possible beam directions which could be achieved with the antenna array 6. The total number of beams provided can be altered as required.

However, in preferred embodiments of the present invention, the antenna array will be a digital array. This means that the angular spread of each beam may be varied as can the angle of transmission by digitally controlling the signal phase on each element of the array. The pattern shown in FIG. 2 can be achieved by a digital phased antenna array. However, this is just one of the possible patterns that can be achieved by a digital phased antenna array. The digital phased antenna array, used in preferred embodiments of the invention, provides more flexibility than an analogue array. However, in other embodiments of the present invention, only the eight possible beam directions shown in FIG. 2 may be provided. In either case, there will generally be an overlap between adjacent beams to ensure that all of the cell sector 2 is served by the antenna array.

Figure 3:
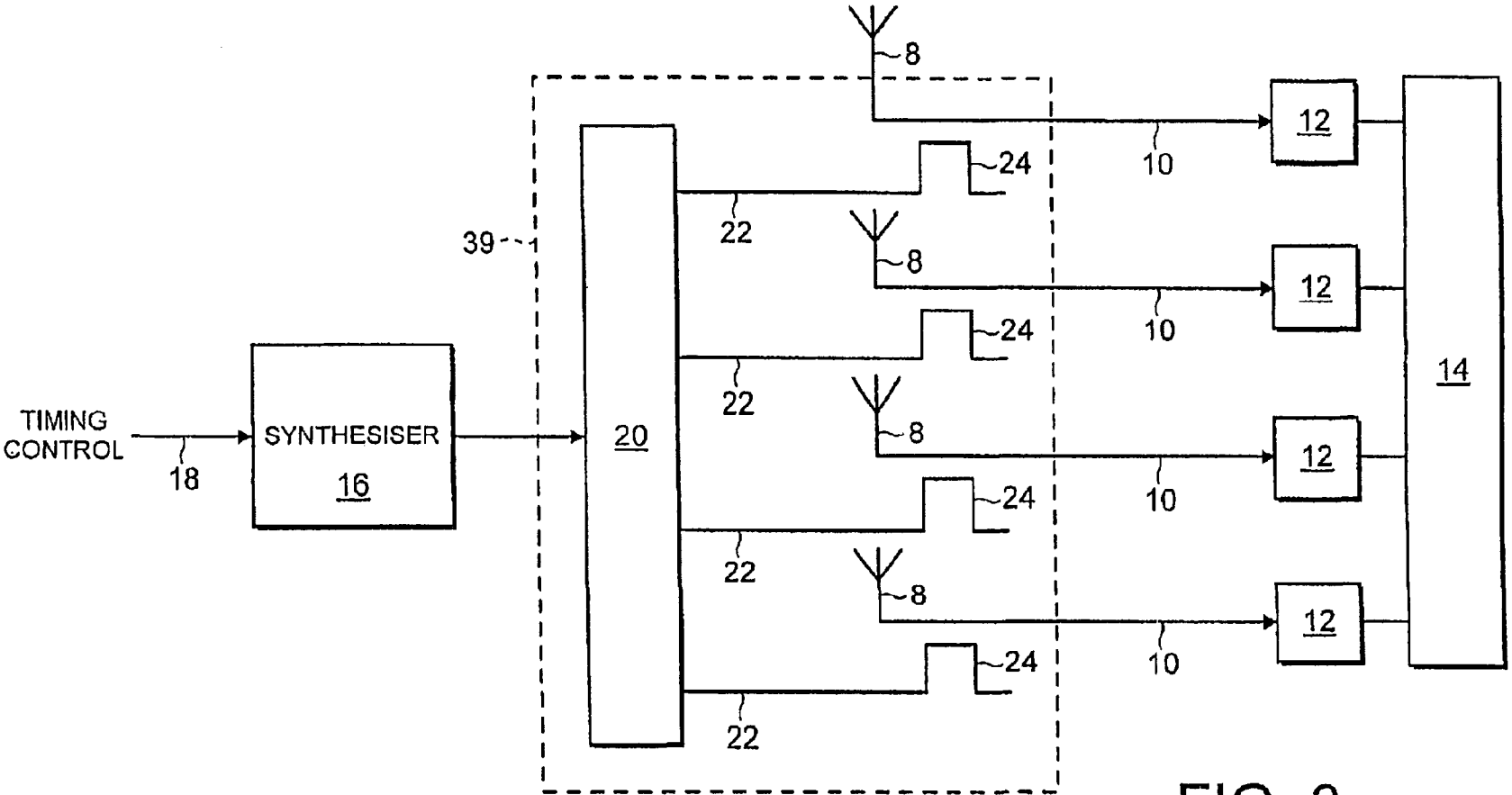
FIG. 3 shows a block diagram of a calibration circuit embodying the present invention for the receive path.

Reference is now made to FIG. 3 which shows a block diagram of a calibration circuit for the receive path. In order to simplify the explanation of an embodiment of the present invention, only four antennas 8 are provided. However, as will be appreciated, it is possible that more than four antennas 8, for example eight antennas 8 may be provided. Each antenna 8 is spaced from the adjacent antenna 8 by a distance of approximately one half wavelength or less.

For clarity, each version of the same signal received by an antenna will be referred to as a signal part. Thus, with four antennas 8, four signal versions of the same signal which are received from different directions and/or at different times will be referred to as signal part.

Each antenna 8 is connected via cables 10 to a respective signal part processor 12. Each signal part processor 12 is arranged to determine the phase of the signal part, with respect to a reference, received from the respective antenna 8 and the absolute power of that received part of the signal. Once the phase and absolute power of each part of the signal received by each antenna 8 has been determined, these results are output to a digital signal processor 14. The digital signal processor 14 compares the phases of the parts of the signal received from each of the antennas 8. Based on the relative phases of the four signal parts received from the respective antennas 8, the digital signal processor 14 is able to determine the direction from which the initial signal has been received. The determining of the direction from the relative phases is well known and will not be described in any further detail.

The power of a signal received from a given direction is determined based on the absolute power calculated by each signal part processor 12 of each signal part. Typically, the power of a signal is determined by summing together the power of each of the signal parts. This information is used to determine whether or not that signal is strongly received from a given direction. Due to multipath effects, a signal may appear to be received from more than one direction. The digital signal processor 14 may therefore be concerned with identifying at least the strongest received version of a signal as this will influence the or each direction in which signals are transmitted to a given mobile station by the base station.

The antennas 8 will typically be arranged at the top of a building and the base station which includes the signal part processors 12 and the digital signal processor 14 may be a few hundred feet from the array. Separate cables 10 connect each signal part processor 12 to the respective antennas 8. Thus, the cables 10 may have different lengths. Additionally, some cables 10 may be more exposed than others leading to different temperatures in different cables 10. As it is difficult to ensure that all of the cables 10 are exactly the same length and always at the exact same temperature, each cable will add a different phase shift to that of the received signal part. Accordingly, the relative phase shifts of the signal parts received by the respective signal part processors 12 may differ from the relative phase shift of the signal parts at each of the antennas 38. In other words, the relative phases of the signal parts at the antennas 8 could, due to the effects of the cables 10, be different from the relative phases of the signal parts received at the digital signal processor 14.

To avoid this problem, a synthesiser 16 is provided which generates a test signal at a desired frequency. The frequency of the signal will be one of those frequencies which are typically received by the antennas 8 in normal use. So as to avoid interference between the test signal and normal traffic, the test signal is generally applied by the synthesiser 16 in a spare time slot in a GSM traffic channel. No signals are received by the antennas 8 from mobile stations at the test frequency in the spare time slot. In order to ensure that the test signal generated by the synthesiser 16 is in an idle time slot, the synthesiser receives a timing control signal via line 18. This timing control signal ensures that the test signal is generated during the idle time slot. The GSM standard defines a dummy burst which is sometimes used as a filler. In preferred embodiments of the present invention, this is used as the test signal. This is advantageous in that the dummy burst is known to the base station and the mobile station and is not mistaken for an actual signal.

The output of the synthesiser 16, which is a single test signal, is applied to a signal splitter 20. The splitter 20 splits the received signal into four signal parts and provides at its outputs 22 four I signal parts. Each of these signals has the same power and exactly the same phase. It is important in embodiments of the present invention that the relative phase of the signal parts output by the signal splitter 20 be known. It is therefore preferred that the relative phase difference between the signal parts output by the signal splitter 20 be zero. The four signal parts output by the splitter 20 are supplied to respective couplers 24. Four couplers 24 are provided and each coupler 24 is coupled to a respective one of the cables 10 between a respective antenna element 8 and a respective signal part processor 12. The paths between each output 22 of the splitter 20 and the respective coupler 24 are identical so that the signals at each of the couplers 24 have the same phase. The distance between the splitter 20 and the couplers 24 can be small and is thus relatively easy to ensure that the length of connection between the splitter 20 and each of the couplers 24 is the same. The synthesiser 16 may be in the base station and thus remote antenna elements 8. The splitter 20 and couplers 24 are arranged at the same location as the antenna elements 8, that is generally some distance from the base station.

The test signal parts from the couplers 24 pass along the respective cables 10 to the signal part processors 12. In other words, the four test signals are then treated as if they had been received by the respective antenna elements 8. Each signal part processor 12 analyses a respective test signal part to determine its phase and power.

The digital signal processor 14 then calculates the relative phase of the four test signal parts. If the path between each antenna element and the respective signal part processor 12 were identical, then the digital signal processor 14 should find no phase difference between the four test signal parts. However, in practice there will be differences between those paths and the digital signal is able to calculate the relative phases introduced by each path. As mentioned hereinbefore, the differences in phase are caused by the cables 10 between the antenna elements 8 and the signal part processors 12 being different lengths and/or being at different temperatures. The digital signal processor 14 therefore calculates correction values so as to take into account the phase delays introduced by the different cables 10.

In one implementation of the present invention, one of the cables 10 is considered to be a reference path. The relative delay introduced by each of the other three cables 10 is compared to that of the reference path. The test signal parts thus allow the relative delays introduced by each cable 10 to be calculated. These values can be taken into account by the digital signal processor 14 when processing signal parts actually received by each antenna element 8. A correction value can be added to the signal parts received via the three cables 10, not providing the reference part. A different correction value can be provided for each of the paths defined by the three cables 10. The correction values can be added to or subtracted from the received signal parts by the digital signal processor 14 or by the respective signal part processors. Thus, the delays introduced by each cable 10 can be compensated. The digital signal processor 14 is able to determine the true relative phase of the signal parts received at each of the antenna elements 8 with respect to each other.

In one modification, a correction value is determined for each of the four paths defined by the four cables 10.

As mentioned hereinbefore, the test signal parts applied to the couplers 24 should be of the same phase. It is preferred that the splitter 20 and the couplers 24 be integrated into the antenna array which includes the antenna elements 8. In this way, it is easier to ensure that the phase of the test signal parts applied to each of the couplers 24 are the same. The signal part processors 12 and digital signal processor 14 as well as the synthesiser 16 may be in the base transceiver station, some distance from the antenna array.

It is possible that the function of the signal part processors 12 and the digital signal processor 14 can be carried out by a single processor, in alternative embodiments of the present invention.

The received signal parts, after combining in the digital signal processor 14, will then be subject to further processing including decoding etc.

Figure 4:
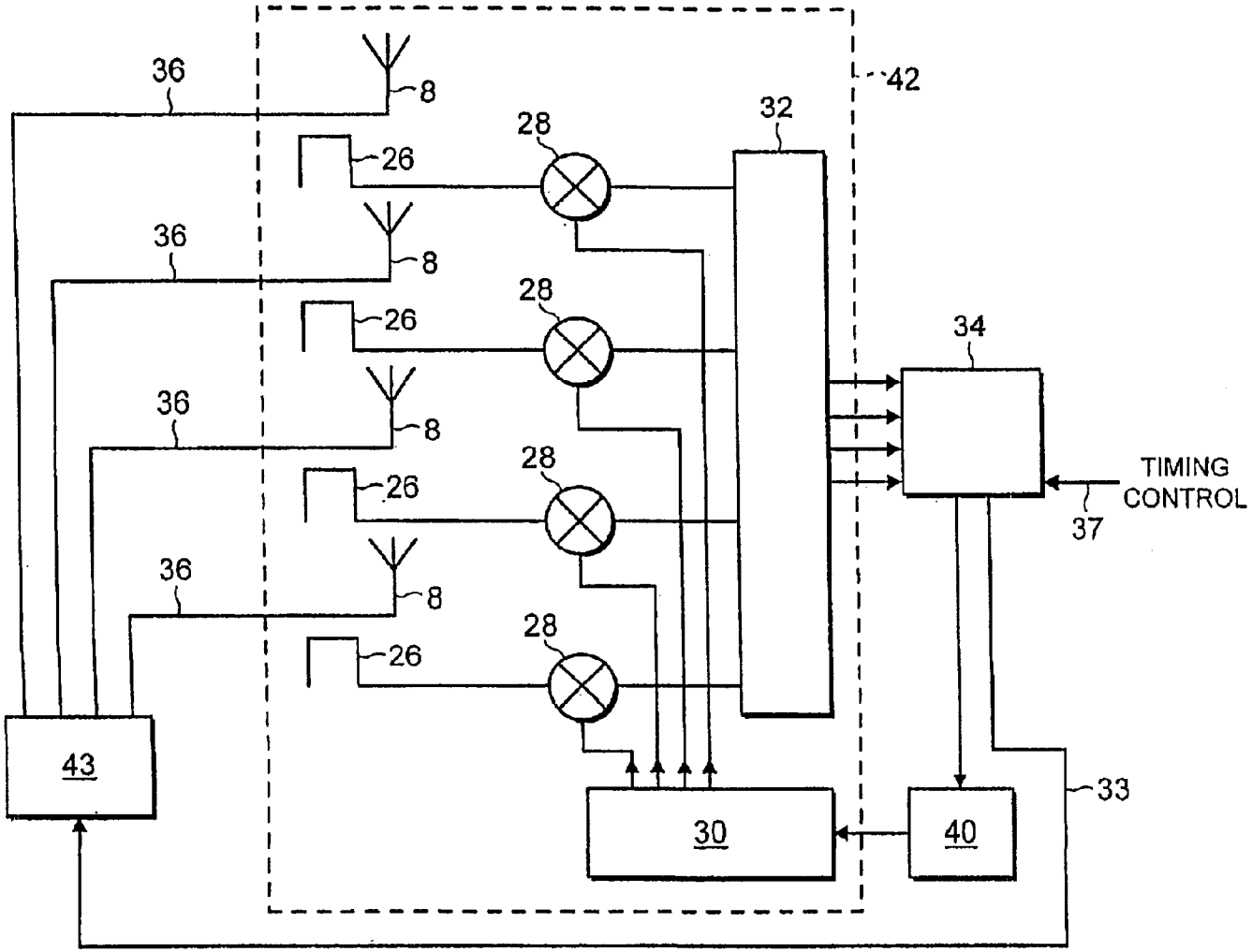
FIG. 4 shows a calibration circuit embodying the present invention for the transmission path.

Reference will now be made to FIG. 4 which illustrates the calibration of signals to be transmitted. The four antennas 8 shown in FIG. 4 are generally the same as those used for receiving and shown in FIG. 3. However, in alternative embodiments of the present invention, separate antennas 8 may be provided for receiving and transmitting signals. In normal use, a signal part which is to be transmitted is supplied to each of the antennas 8 with the required relative phase differences to ensure that a beam is generated in a given direction. Typically each antenna 8 is connected to the base station by four cables 36, one for each antenna. The cables 36 between the base station and the respective antennas 8 may be of different lengths and/or at different temperatures. The signal parts applied to each antenna 8 may therefore not have the required relative phase. This means that a beam may not be generated in the desired direction. Accordingly as with the receiving part of the circuit, calibration is carried out.

A test signal part is applied in a spare time slot to each of the antennas via the respective cable 36. The test signal parts are generated in the base station and are passed to the respective antenna elements via the respective cables 36. The test signal parts are generated by the digital signal processor and transmit upconversion chain(s) in the transmitter 43. The relative phase difference between each of the test signal parts output by the transmitter 43 is set to zero.

The test signal parts which are applied to the antenna elements are again generally a dummy burst and are at a frequency at which the antenna elements usually transmit signals. A coupler 26 is connected to each cable 36 to sample the test signal part. Four couplers 26 are provided, one for each cable 36. The signal part from each coupler 26 is input to a respective mixer 28. Four mixers are provided. Each mixer 28 receives a separate signal from a mixer feed splitter 30. Each signal provided by the mixer feed splitter 30 to the four mixers 28 has the same phase. Each mixer 28 mixes the signal from the mixer feed splitter 30 with the test signal part from the corresponding coupler 26. The frequency of the signal output by each mixer 28 is considerably lower than that of the test signal part and may be of the order of 70 KHz. The test signal part will typically be at the radio frequency, for example of the order of 800 to 900 MHz.

The output of each mixer 28 is input to a converter block 32 which carries out low pass filtering to remove unwanted noise and then converts the analogue signal to digital form. To allow this conversion, the converter block 32 carries out a sample and hold function. The converter block 32 provides four outputs one corresponding to each input received from a respective one of the mixers 28. The outputs of the converter block 32 are input to the digital signal processor 34 which may be the same as the digital signal processor 14 of FIG. 3. The digital signal processor 34 compares the relative phase of each of the four test signal parts. As the test signal parts initially have the same phase, and differences which are found by the digital signal processor 34 are introduced by the cables 36 between the antenna elements 8 and the base transceiver station. In the same way as for the arrangement of FIG. 3 a phase value can be determined for each path. Alternatively, one path can act as a reference value and the phase offset or correction on values can be defined with respect to the reference path.

Thus, the phase offset or correction values to be applied to each of the signal parts to be transmitted in order to get the required relative phase values at the antenna element 8 are calculated by the digital signal processor 34 and sent to the digital signal processor in the transmitter 4. The signal parts to be generated are generated by the transmitter 43 which generates each signal part with the required relative phase values, taking into account the respective correction values. In the arrangement shown the test data and the data to be transmitted is provided by the digital signal processor 34. However this data may be provided by a separate entity.

The digital signal processor 34 controls the transmission of the signal parts and thus receives a timing and control input 36 which controls the generation of the test signals so that they occur in a spare time slot in the traffic channel. The digital signal processor 34 ensures that the test signal is generated during a spare time slot.

The digital signal processor 34 is connected to a synthesiser 40 and controls the frequency at which the synthesiser 40 generates a signal. The synthesiser 40 has its output connected to the mixer feed splitter 30 so as to control the frequency with which the received signal part or the test signal parts are mixed.

The mixers 28, the couplers 26 and the converter block 32 are all integrated into the antenna array along with the mixer feed splitter 30. The synthesiser 40 and digital signal processor 34 are incorporated in the base transceiver station which may be spaced apart from the antenna array.

With this arrangement as with the arrangement described in relation to FIG. 3, it is desirable to continually update the calibration readings so as to track phase shifts resulting for example from temperature changes. In some GSM full rate traffic channels, an idle time slot may occur once every 26 frames. Calibration readings may be carried out with this frequency or with a lower frequency.

For both the transmit and receive calibration, the test signal is provided at each of the frequencies used for transmission and receiving respectively. This can be done in successive idle transmit and receive time slots respectively.

Figure 5:
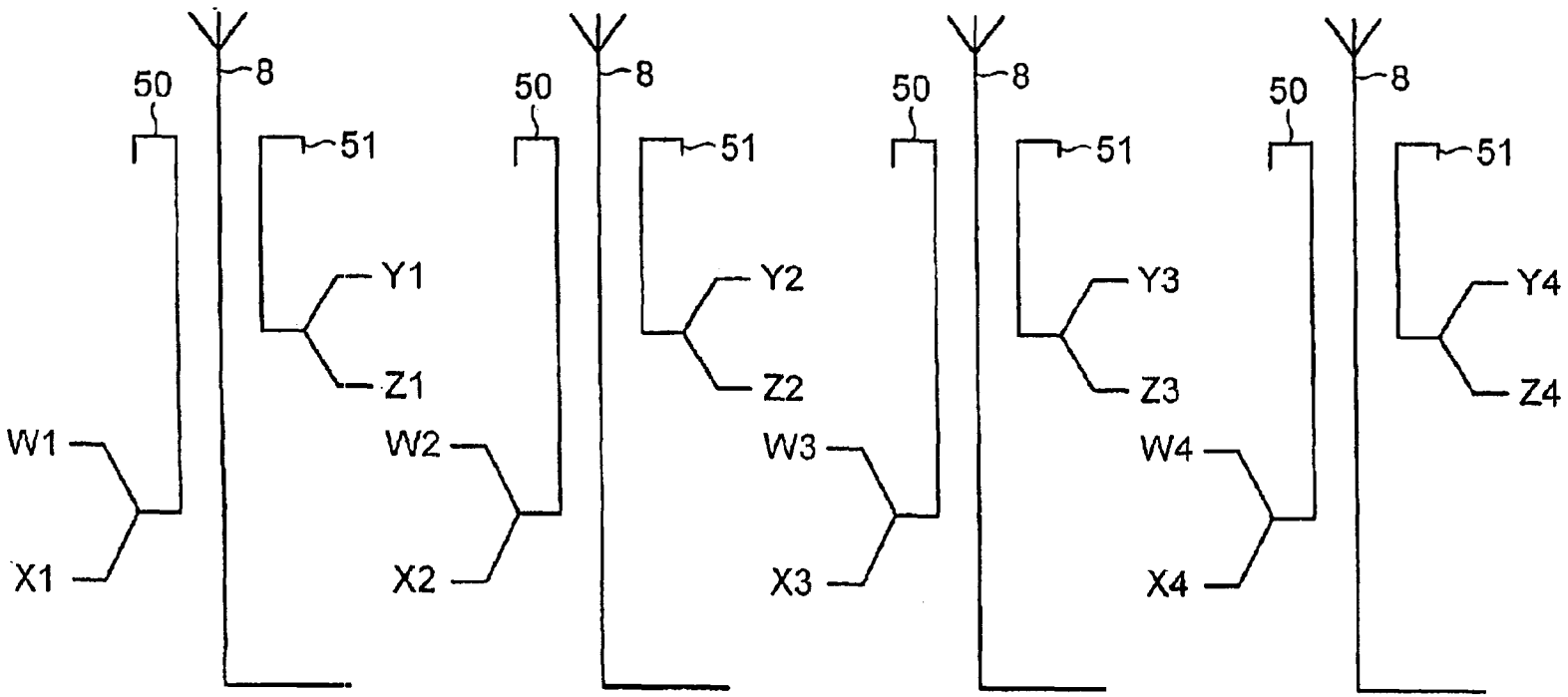
FIG. 5 shows a directional coupler arrangement of an embodiment of the present invention.

FIG. 5 shows in more detail a directional coupler arrangement as used in an embodiment of the present invention which has two calibration systems. Each calibration system has a receive calibration circuit and a transmit calibration circuit as shown in FIGS. 3 and 4. As can be seen, each antenna 8 is connected to the calibration system by two separate directional couplers 50 and 51 located on each of the antenna elements. One directional coupler 50 interfaces the antenna array and one of two calibration systems. The other directional coupler 51 interfaces the antenna array and the other of the calibration systems. During the transmission calibration period a fraction of the transmit test signal is directed by the directional couplers 50 and 51 into the transmit part of the respective calibration systems. During the receive calibration period, the test signal is directed by the directional couplers 50 and 51 to the receive part of the respective calibration systems.

The output of the directional couplers 50 and 51 are attached to a splitter such that at each antenna output there are four paths through which signals can travel, these are labelled Wn, Xn, Yn, Zn where n is a number representing the number of the antenna in question. Wn and Xn are fed into a first calibration system and as it is fed from directional coupler 50 are independent of Yn and Zn which are fed into a second calibration system from directional coupler 51. Wn is used in the receive calibration part of the first calibration system and Xn is used in the transmit calibration part of the first calibration system. Yn is used in the receive calibration part of the second calibration system and Zn is used in the transmit calibration part of the second calibration system. The features of the two separate calibration systems are described hereinafter. As the two separate calibration systems are fed from two independent directional couplers 50 and 51, the isolation between the two calibration systems is increased. This means that a failure of one calibration system will not indicate that there is an error with the other calibration system.

Figure 6:
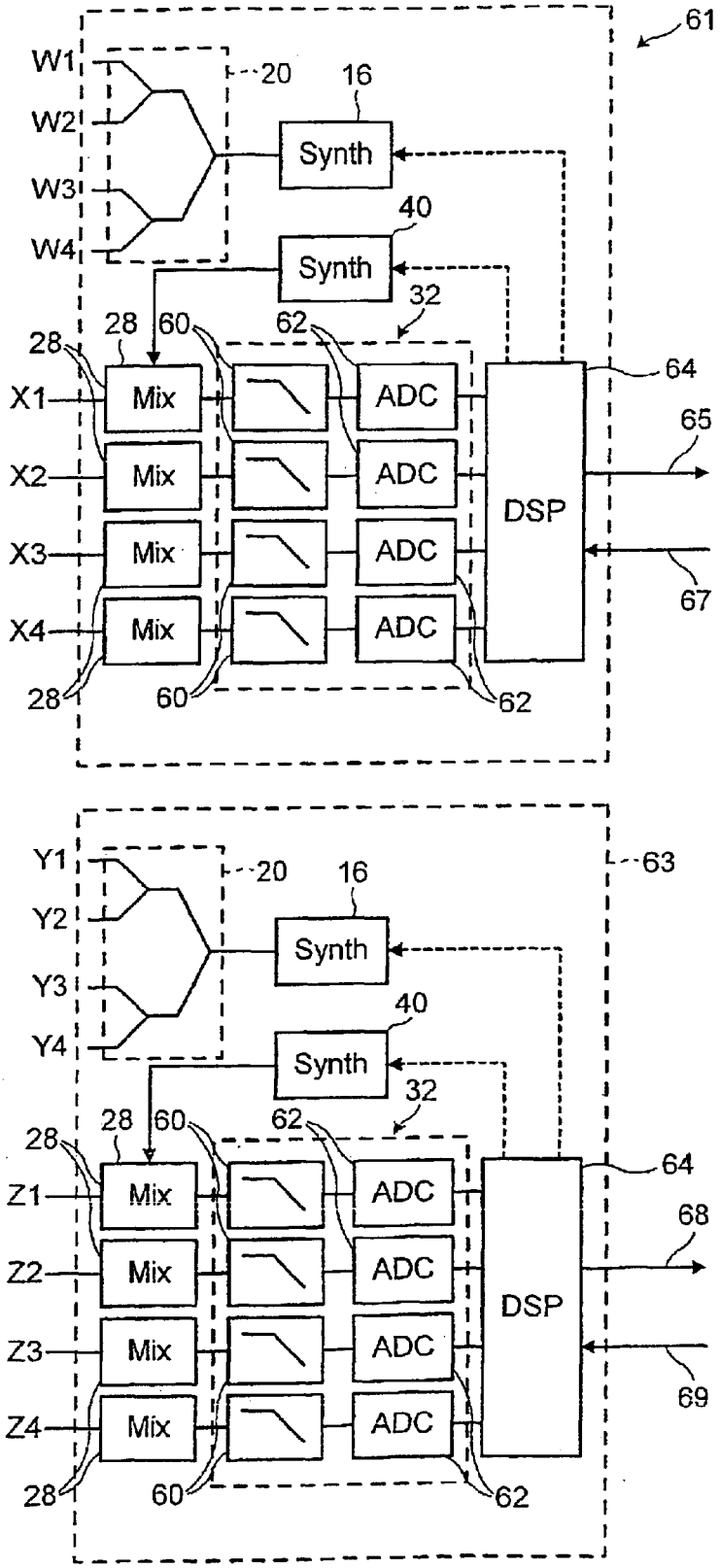
FIG. 6 shows a block diagram of an arrangement embodying the invention with two calibration circuits.

Referring now to FIG. 6, which shows an embodiment of the present invention. As can be seen, FIG. 6 comprises a simplified block diagram with two calibration systems 61 and 63 each containing the features of both FIG. 3 and FIG. 4. Some elements of FIGS. 3 and 4 have been omitted for clarity. The first and second calibration systems are independent of each other. They are the same as one another. The paths labelled Wn in FIG. 5 are attached to the output of the splitter 20 of the first calibration system. This means that each output path Wn will receive an equal share of the input signal. Likewise, the path labeled Yn is attached to the output of the splitter 20 of the second calibration system. Attached to the input of the splitter 20 is the output of the frequency synthesiser 16. The frequency synthesizer can be located near the antennas or in the base station. The frequency synthesiser 16 generates the test signal at a desired frequency. Connected to the input of the frequency synthesiser 16 is the digital signal processing circuitry apparatus 64 which incorporates the digital signal processors of the transmit and receive calibration circuitry of FIGS. 3 and 4.

The frequency synthesiser 40 of the transmit part generates the frequency signal which is input to the number of mixers 28. In the arrangement of FIG. 6, the synthesiser 40 is arranged at the antenna array. It may alternatively be as shown in FIG. 4 at the base station. Each mixer 28 of the transmit part receives a separate signal Xn in the case of the first calibration circuit or Zn in the case of the second calibration circuit from one of the directional couplers 50 or 51. The output from each mixer 28 is fed to the input of the convertor block 32 as described with the arrangement of FIG. 4.

In the arrangement of FIG. 6, the convertor block 32 comprises four low pass filters 60 connected to the outputs of the mixers and four analogue to digital converters 62 connected to the outputs of the low pass filters 60. The output of the convertor block 32 is presented to inputs of the digital signal processing circuitry apparatus 64.

The digital signal processing 64 has a further input 67 and 69 and a further output 68. The output and input lines 65 to 69 are connected to a microprocessor whose function will be described later.

Although this embodiment has two calibration systems, more or less than two such systems may be provided.

Figure 7:
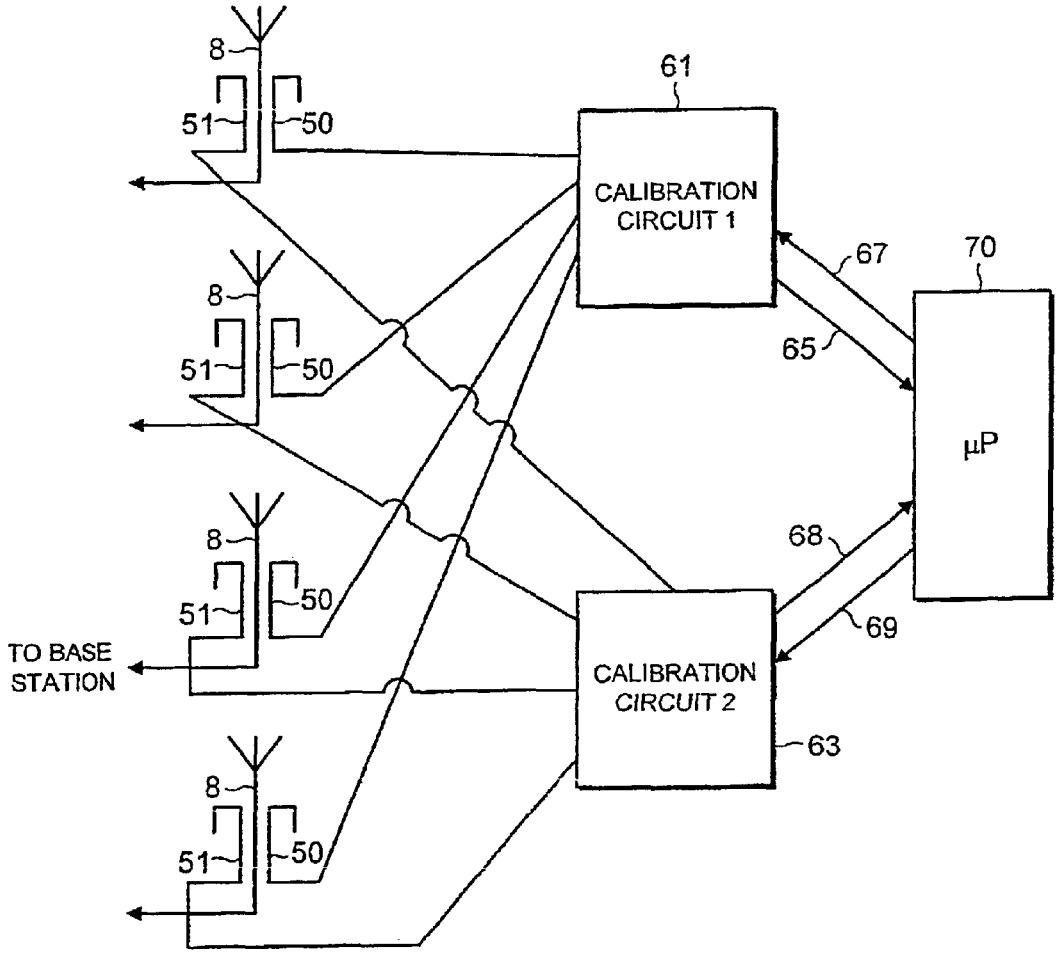
FIG. 7 shows a block diagram of a system incorporating the arrangement of FIG. 6.

Reference will now be made to FIG. 7. As can be seen, each directional coupler 50 and 51 associated with each antenna is connected to a respective one of the calibration systems 61 and 63. The first calibration system 61 is connected, and works in parallel to, the second calibration system 63. The output 65 and 68 of each calibration unit is connected to a microprocessor 70. Additionally, an output 67 and 69 from the microprocessor 70 is connected to an input of each of the calibration systems. This means that there is two way independent communication between the microprocessor 70 and each of the calibration systems. The microprocessor 70 may be situated close to the calibration systems or some distance away, for example in the base station.

Figure 8:
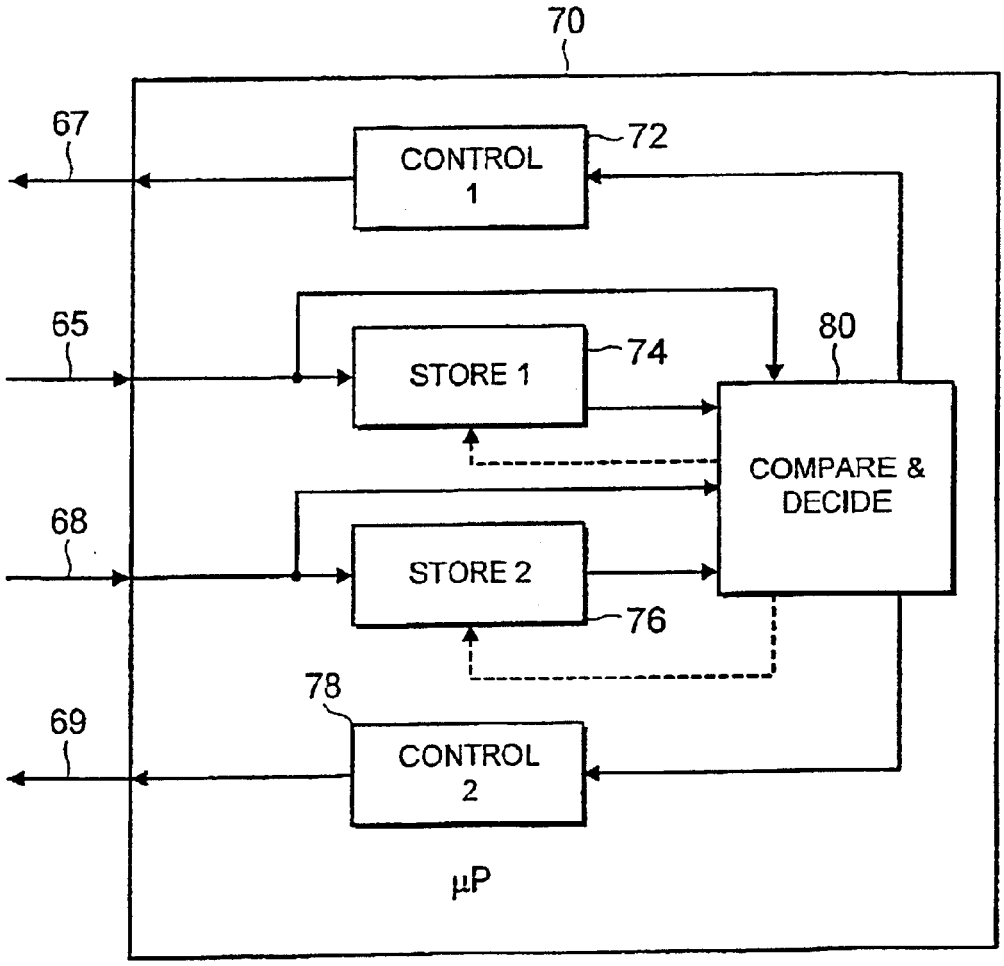
FIG. 8 shows a block diagram of a microprocessor used to control the calibration units in embodiments of the present invention.

FIG. 8 shows a block diagram of the microprocessor as used in a preferred embodiment of this invention. At the input of the microprocessor 70 are the two input lines 65 and 68. The input lines 65 and 68 are connected to the output of the first and second calibration systems as previously described. The input lines 65 and 68 are connected to the input of a respective store 74 and 76 or memory. The first store 74 is connected to the first calibration system 61 and the second store 76 is connected to the second calibration system 63. The first memory store 74 receives and stores phase and/or power information data from the first calibration system 61. Additionally, the second memory store 76 receives and stores phase and/or power information data from the second calibration system 63. The information received and stored in the first memory store 74 is collected and stored independently of that which is received and stored in the second memory store 76.

A compare and decide module 80 also receives the outputs from the respective first and second calibration circuits.

The compare and decide module 8 receives the phase and/or power information data from the first and second calibration systems at substantially the same time as the first and second memory stores 74 and 76 respectively. One output from the compare and decide module 80 is connected to a first control unit 72. The compare and decide unit 80 outputs a command to the first control unit 72 so that the first control unit 72 exclusively controls the function of the first calibration system 61. A second output from the compare and decide module 80 is connected to a second control unit 78. The compare and decide unit 80 outputs a command to the second control unit 78 so that the second control unit 78 exclusively controls the function of the second calibration system 63. The output of the first control unit 72 is connected to a first output line 67 which is connected to an input of the first calibration unit 61. The output of the second control module 78 is connected to a second output line 69 which is connected to an input of the second calibration system 63.

The first and second memory stores 74 and 76 may take the form of any suitable memory means and may be part of the microprocessor or may be located externally of that processor.

The compare and decide module 80 receives phase correction information from the first calibration system 61 and from the second calibration system 63. The compare and decide module 80 compares the phase correction information received from the first calibration system 61 with the information received from the second calibration system 63. The compare and decide module 80 compares the received data from both the first and second calibration systems 61 and 63 with what the compare and decide module 80 is expecting. For example, the relative phases of the test signals applied in embodiments of the present invention can be altered. The relative phases of the test signals are known. The response of the calibration systems can be checked. If the relative phases are altered compared to a previous measurement, then it can be checked to see if the respective calibration systems provided an expected increase or decrease in the correction values, depending on the changes made to the relative phases. The compare and decide module makes the decision as to which of the calibration systems are used in order to compensate for phase variation introduced, by for example, the cabling. In preferred embodiments of the invention, a plurality of transceivers may be provided, one for each receive and transmit frequency pair. The compare and decide module is common to all the transceivers. The calibration values for all the frequencies will be considered. The calibration values should change with increasing or decreasing frequency. If this does not occur, the compare and decide module can determine that there is a problem with one of the calibration units. Thus in preferred embodiments of the present invention the compare and decide module will have information about each of the transmit and receive frequencies and will have information on a plurality of readings for each frequency.

The compare and decide unit 80 will also compare the difference between the values provided by the first calibration system 61 and the second calibration system 63. These values should be similar because the first and second calibration systems 61 and 63 are measuring substantially similar quantities. Within the compare and decide module 80, there is a threshold value, this threshold value may be pre programmed and is such that if an error has occurred on either one or both of the calibration units, the difference between the values supplied to the compare and decide module 80 will be greater than this threshold value. This indicates incorrect operation of either the first or second calibration system 61 or 63 or both systems and so enabling the compare and decide module 80 take appropriate action. The compare and decide unit may ignore any results which are very different to previous results.

As a single reading given by either or both of the calibration systems may be transitorily incorrect due to, for example electrical noise, the compare and decide unit 80 compares a plurality of measurements before making a decision as to what action, if any, may be required. These measurements may be stored in the first and second memory store 74 and 76. The compare and decide module 80 calculates the mean average of the phase measurements made by one or both of the calibration systems. This calculated mean average is used to make a decision as to which calibration system is to be used. The compare and decide module 80 also controls the calibration systems such that readings of the phase are made at least one and preferably all the frequencies at which the antenna array 8 operates.

Generally, one calibration system is selected to provide the compensation. However in alternative embodiments, an average of the results from the two systems may be used.

Figure 9:
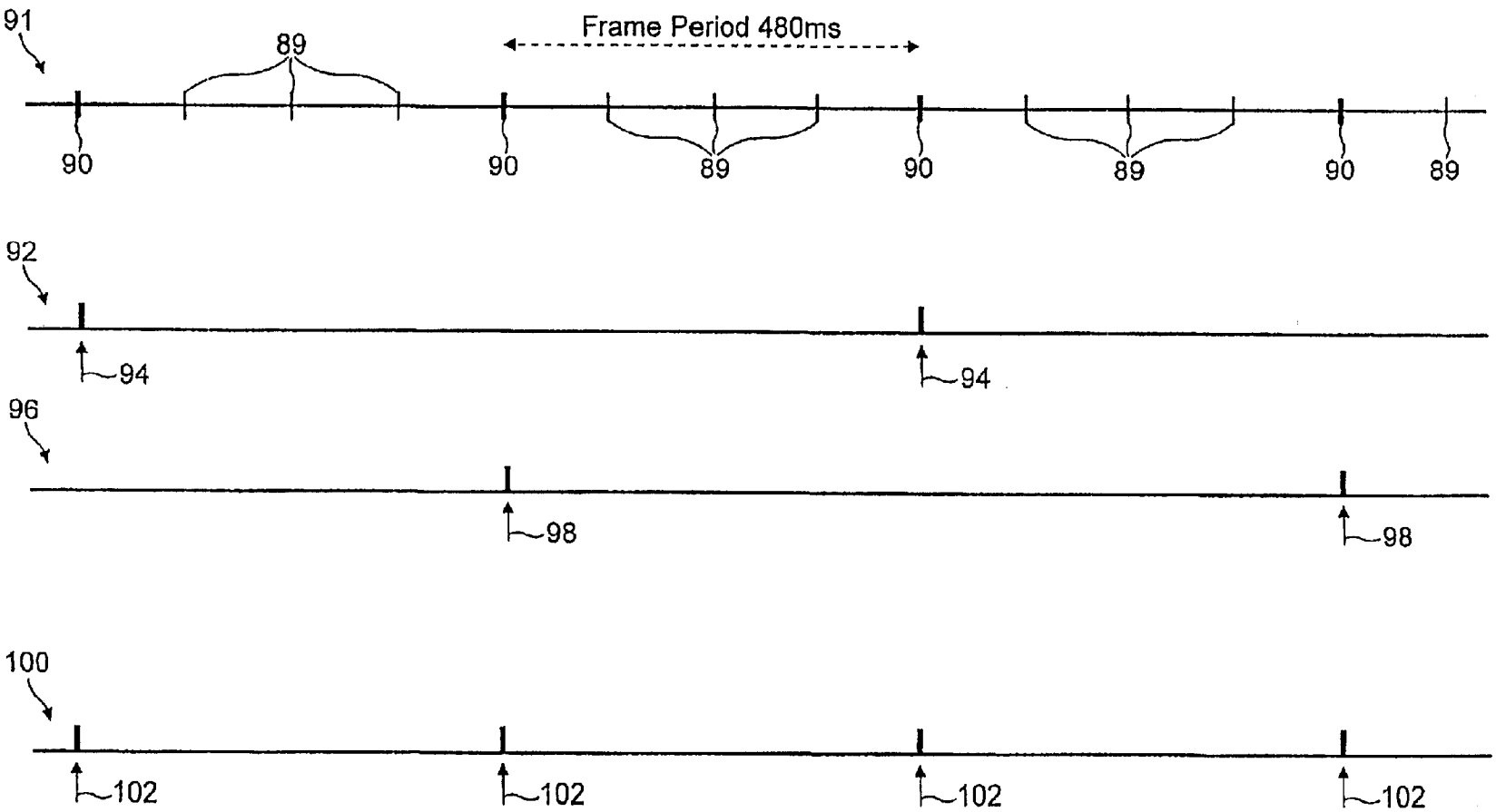
FIG. 9 is a timing diagram showing when embodiments of the present invention insert calibration signals.

FIG. 9 gives a detailed timing diagram showing when each calibration system is active. The calibration takes place on one idle frame in every slow associated control channel (SACCH) period of 104 frames or multiple of this. It should be appreciated that this is by of example only and calibration can be performed more or less frequently than this. This means that calibration takes place every 480 ms. As is shown in FIG. 9 the frame timing 91 gives an indication of when idle frames 89 may become available on the SACCH. The idle slots 90 however are the slots used to calibrate the transmit and receive phase and these are spaced apart by 104 frames or 480 ms. The slots when the first calibration unit calibrates the received signal 94 are termed even number multiframes and the slots when the second calibration unit calibrates the received signal 98 are termed odd number multiframes. In other words, each calibration unit calibrates the received signal on alternate multiframes or every 960 ms. Transmit calibration 102 takes place at substantially the same time in both the first and second calibration systems 61 and 63. This means that the transmit signal is measured by both the first and second calibration systems every 480 ms. The different frequencies are tested in successive idle slots. It should be noted that in this particular embodiment, the receive calibration is undertaken three timeslots later than the transmit calibration on either the first or second calibration system 61 or 63 to allow for the base station to switch from transmit mode to receive mode.

Whilst the embodiment of the present invention has been described in the context of a GSM system, it should be appreciated that embodiments of the present invention can be used in any other digital system or in analogue systems. Embodiments of the present invention can be used in systems which use frequency division multiple access (FDMA), time division multiple access (TDMA) or hybrids of any of the aforementioned systems.

Whilst embodiments of the present invention have been described in the context of base stations, embodiments of the present invention can be used in any situation which requires an antenna array. Embodiments of the invention can also be used in situations where the signals having the same phase are to be applied to the antennas 8.

Whilst embodiments of the present invention have been described in the context of the mitigation of phase errors, embodiments of the present invention can be modified to correct for other errors introduced by cabling such an alteration of amplitude or the like.

What is claimed is:

1. A system for use with an antenna array having a plurality of antennas, said system comprising:

a first calibration arrangement for calibration of transmit or receive signals of said antenna array;

a second calibration arrangement for calibration of the one of the transmit or receive signals of said antenna array; and selection means for selecting one of said calibration arrangements for calibration signals of said antenna array.

2. A system as claimed in claim 1, wherein said calibration arrangements are arranged for calibration of both transmit and receive signals.

3. A system as claimed in claim 1, wherein said first and second calibration arrangements are independent of each other.

4. A system as claimed in claim 1, wherein said selection means receives calibration information from said first calibration arrangement and said second calibration arrangement and based on said information selects one of said calibration arrangements for calibration of signals of said array.

5. A system as claimed in claim 4, wherein said selection means comprises memory means for storing said information from said calibration arrangement.

6. A system as claimed in claim 5, wherein said memory means is arranged to store information received from said calibration arrangements over a period of time.

7. A system as claimed in claim 6, wherein said selection means is arranged to average the information received form said first and second calibration arrangement and to make a selection decision based on said averages.

8. A system as claimed in claim 1, wherein said selection means compares information received from said first and said second calibration arrangements and if the difference in said information exceeds a given threshold, determines that one or both of said calibration arrangements has failed.

9. A system as claimed in claim 1, wherein each antenna has a coupling arrangement coupled to the first and second calibration arrangement.

10. A system as claimed in claim 9, wherein said coupling arrangement has a first coupler associated with each antenna, said first coupler coupled to said first calibration arrangement and a second coupler associated with each antenna, said second coupler being associated with the second calibration arrangement.

11. A system as claimed in claim 1, wherein said antenna array is arranged to communicate with the remote location via connection means, said first and second calibration means being arranged to calibrate for errors caused by said connection means.

12. A system as claimed in claim 11, wherein said connection means comprises a plurality of connectors, one of said connectors being selected as a reference and compensation for the other connector(s) being defined by said calibration arrangements with respect to the reference.

13. A system as claimed in claim 11, wherein said connection means comprises a cable.

14. A system as claimed in claim 11, wherein said first and second calibration arrangements are each arranged to determine phase changes in the antenna signals introduced by said connection means.

15. A system as claimed in claim 11, wherein said first and second calibration means are each arranged to provide correction values which are used to compensate for errors introduced by said connection means.

16. A system as claimed in claim 11, wherein said first and second calibration arrangements are each arranged to apply a calibration signal to the connection means.

17. A system as claimed in claim 16, wherein said calibration signal is of a frequency used in a normal operation.

18. A system as claimed in claim 16, wherein a plurality of different calibration signals are used, said different calibration signals being at the frequencies used in normal operation.

19. A system as claimed in claim 16, wherein said calibration signal is split by said calibration arrangements into a plurality of signal parts, the number of signal parts being equal to the number of antennas.

20. A system as claimed in claim 1, wherein a first plurality of calibration signals are applied to the respective antenna elements with a first relative phases and a second plurality of calibration signals are applied to the respective antenna element with second relative phases, said selection means being arranged to determine if at least one of said first and second calibration arrangements provides an expected output in response to the second plurality of calibration signals as compared to the output in response to the first plurality of signals.

21. A system as claimed in claim 20, wherein said first and second plurality of calibration signals are at the same frequency.

22. A system as claimed in claim 20, wherein said first and second plurality of calibration signals are at different frequencies.

23. A system as claimed in claim 20, wherein said selection means is arranged to select a calibration arrangement if said arrangement provides an expected output.

* * * * *